US005752631A

United States Patent [19]

Yabuno et al.

[11] Patent Number: 5,752,631

[45] Date of Patent: May 19, 1998

[54] VALVE DEVICE FOR AEROSOL CONTAINER

[75] Inventors: Kimio Yabuno, Nara; Kazunori Hoshino, Zushi, both of Japan

[73] Assignees: Soft 99 Corporation, Osaka; Toyo Aerosol Industry Co., Ltd., Tokyo, both of Japan

[21] Appl. No.: 787,634

[22] Filed: Jan. 23, 1997

[30] Foreign Application Priority Data

Mar. 19, 1996 [JP] Japan ..... 8-063085
Oct. 3, 1996 [JP] Japan ..... 8-263333

[51] Int. Cl.[6] ..... B65D 83/14

[52] U.S. Cl. ..... 222/402.1; 222/564

[58] Field of Search ..... 222/402.1, 564, 222/547; 239/337

[56] References Cited

U.S. PATENT DOCUMENTS 3,396,874 8/1968 Malone ..... 222/402.1
4,396,152 8/1983 Abplanalp ..... 329/337

FOREIGN PATENT DOCUMENTS 531606 11/1992 European Pat. Off. ..... 222/402.1
2187513 9/1987 United Kingdom ..... 222/402.1

*Primary Examiner*—Philippe Derakshani
*Attorney, Agent, or Firm*—Kanesaka & Takeuchi

[57] ABSTRACT

Disclosed herein is a valve device for an aerosol container, comprising a housing the upper end of which is fixed to the interior of a lid, a partition wall arranged in the housing and provided with an insertion hole, an upper chamber provided above the partition wall, a lower chamber provided below the partition wall, a stem vertically movably installed in the upper chamber and provided with a pressing part at its lower end, the upper end of said stem being biased and projected outward from the lid through a stem gasket, a change-over valve vertically movably installed in the lower chamber facing the pressing part situated at the lower end of the stem, and a flow path for small spraying, which is made in the change-over valve and communicates the upper chamber with the lower chamber, wherein the change-over valve is pressed against and biased toward a valve seat provided on the lower surface of the partition wall, whereby the communication of the upper chamber with the lower chamber is cut off except for through the flow path for small spraying, and the insertion hole can be opened by pressing down the change-over valve by the stem.

7 Claims, 10 Drawing Sheets

VALVE DEVICE FOR AEROSOL CONTAINER

BACKGROUND OF THE INVENTION

1. Field of the Invention

The present invention relates to valve devices for aerosol containers which are used for filling and spraying with aerosol contents such as, for example, hair cosmetics, cosmetics, deodorants, perspiration preventives, other goods for human bodies; insecticides, coating formulations, cleaners, other household goods; industrial goods; or automotive goods.

2. Description of the Background Art

There have heretofore been aerosol containers which can change over a spray pattern according to the need. For example, in the device described in Japanese Utility Model Publication No. 36630/1990, the spray pattern is changed over among cases where aerosol contents are applied to an object through a coating member impregnated with the contents, where the aerosol contents are applied to an object by spraying and where the aerosol contents are applied to the interior of an object by inserting a nozzle of the aerosol container into the object.

In the device described in Japanese Utility Model Publication No. 53712/1991, also, the spray pattern is changed over among cases where aerosol contents are applied to an object through a coating member impregnated with the contents, where the aerosol contents are applied to an object by spraying and where the aerosol contents are applied to the interior of an object by inserting a nozzle of the aerosol container into the object.

As other conventional aerosol containers, there have been containers which are constructed in such a manner that when aerosol contents are sprayed, they can be applied in wide and narrow ranges to permit the changeover of the spray patterns. The changeover of these spray patterns is carried out by selecting a nozzle, by which spraying of a wide spray pattern is permitted, among plural nozzles when the aerosol contents are intended to apply to a wide area. When the aerosol contents are intended to apply to a narrow area, a nozzle, by which spraying of a small spray pattern is permitted, is selected among the plural nozzles to spray the aerosol contents.

In the conventionally known aerosol containers as described above, however, the amounts of the aerosol contents sprayed per unit time are the substantially same in both small or narrow spray pattern and large or wide spray pattern.

Therefore, when the aerosol contents are sprayed after the small spray pattern, the amount of the aerosol contents sprayed per unit area becomes extremely large, so that sag occurs on an object coated, and excess of the aerosol contents is sprayed. When the aerosol contents are sprayed after the wide spray pattern on the other hand, the amount of the contents sprayed per unit area is insufficient, so that the spraying must be continued over a long period of time. This case is also not preferred. If the amount of the contents to be sprayed is determined to fit one of these spray patterns, such an aerosol container involves a drawback that preferable spraying can be conducted in said one spray pattern, but the evil becomes more marked in the other spraying condition.

SUMMERY OF THE INVENTION

It is an object of the present invention to provide a valve device for an aerosol container, which can eliminate the above-described drawbacks to decrease the amount of aerosol contents to be sprayed when the contents are intended to be sprayed in a small or narrow spray pattern or increase the amount of the aerosol contents to be sprayed when the contents are intended to be sprayed in a wide range after a large spray pattern, thereby preventing the occurrence of sag or improving the situation that the spraying must be conducted over a long period of time.

The present invention has been completed with a view toward achieving the above object.

According to a first aspect of the present invention, there is thus provided a valve device for an aerosol container, comprising a housing the upper end of which is fixed to the interior of a lid, a partition wall arranged in the housing and provided with an insertion hole, an upper chamber provided above the partition wall, a lower chamber provided below the partition wall, a stem vertically movably installed in the upper chamber and provided with a pressing part at its lower end, the upper end of said stem being biased and projected outward from the lid through a stem gasket, a change-over valve vertically movably installed in the lower chamber facing the pressing part situated at the lower end of the stem, and a flow path for small spraying, which is made in the change-over valve and communicates the upper chamber with the lower chamber, wherein the change-over valve is pressed against and biased toward a valve seat provided on the lower surface of the partition wall, whereby the communication of the upper chamber with the lower chamber is cut off except for through the flow path for small spraying, and the insertion hole can be opened by pressing down the change-over valve by the stem.

According to a second aspect of the present invention, there is also provided a valve device for an aerosol container, comprising a housing the upper end of which is fixed to the interior of a lid, a partition wall arranged in the housing and provided with an insertion hole, an upper chamber provided above the partition wall, a lower chamber provided below the partition wall, a stem vertically movably installed in the upper chamber and provided with a pressing part at its lower end, the upper end of said stem being biased and projected outward from the lid through a stem gasket and said pressing part situated at the lower end of the stem may being insertable into the insertion hole, a change-over valve vertically movably installed in the lower chamber facing the pressing part situated at the lower end of the stem, and a flow path for small spraying, which is made in the change-over valve and communicates the upper chamber with the lower chamber through the insertion hole, wherein the change-over valve is pressed against and biased toward a valve seat provided on the lower surface of the partition wall, whereby the insertion hole is cut off except for through the flow path for small spraying, and the insertion hole can be opened by pressing down the change-over valve by the stem.

According to a third aspect of the present invention, there is further provided a valve device for an aerosol container, comprising a housing the upper end of which is fixed to the interior of a lid, a partition wall arranged in the housing and provided with an insertion hole, an upper chamber provided above the partition wall, a lower chamber provided below the partition wall, a stem vertically movably installed in the upper chamber and provided with a pressing part at its lower end, the upper end of said stem being biased and projected outward from the lid through a stem gasket, said pressing part situated at the lower end of the stem being arranged facing the insertion hole, a change-over valve vertically movably installed in the lower chamber facing the pressing part situated at the lower end of the stem, a part of said change-over valve to be pressed by the stem being projected into the upper chamber from the insertion hole, and a flow path for small spraying, which is made in the change-over valve and communicates the upper chamber with the lower chamber, wherein the change-over valve is pressed against and biased toward a valve seat provided on the lower surface of the partition wall, whereby the insertion hole is cut off except for through the flow path for small spraying, and the insertion hole can be opened by pressing down the change-over valve by the stem.

The upper chamber and the lower chamber may be defined by a partition wall provided integrally with the housing by projecting the inner peripheral surface of the housing inward.

A ring-like partition wall formed separately from the housing may be inserted and installed in the housing to define the upper chamber and the lower chamber by the ring-like partition wall.

A concave groove through which the aerosol contents flow may be formed in an inner surface of the lower chamber facing the outer periphery of the change-over valve in order that the concave flow groove may be communicated with the insertion hole when the change-over valve is pressed down by the stem.

The change-over valve may be formed in such a manner that its outer diameter is smaller than an inner diameter of the lower chamber, whereby a space through which the aerosol contents flow is provided between the outer peripheral surface of the change-over valve and the inner peripheral surface of the lower chamber.

Since the valve devices for aerosol containers according to the present invention are constructed as described above, a proper amount of aerosol contents can be sprayed without causing problems such as sag even in spraying on a narrow spray pattern. It is also possible to efficiently spray the aerosol contents by spraying a large amount of the aerosol contents at a time even in spraying on a wide spray pattern.

Since the amounts of the aerosol contents sprayed per unit area are the substantially same in both spraying of the aerosol contents on a wide area and spraying of the aerosol contents on a small area, coating can be evenly performed without spots.

Other objects, features and advantages of the present invention will be readily appreciated from the preferred embodiments of the present invention, which will be described subsequently in detail with reference to the accompanying drawings.

BRIEF DESCRIPTION OF THE INVENTION

DETAILED DESCRIPTION OF THE INVENTION

Figure 1:
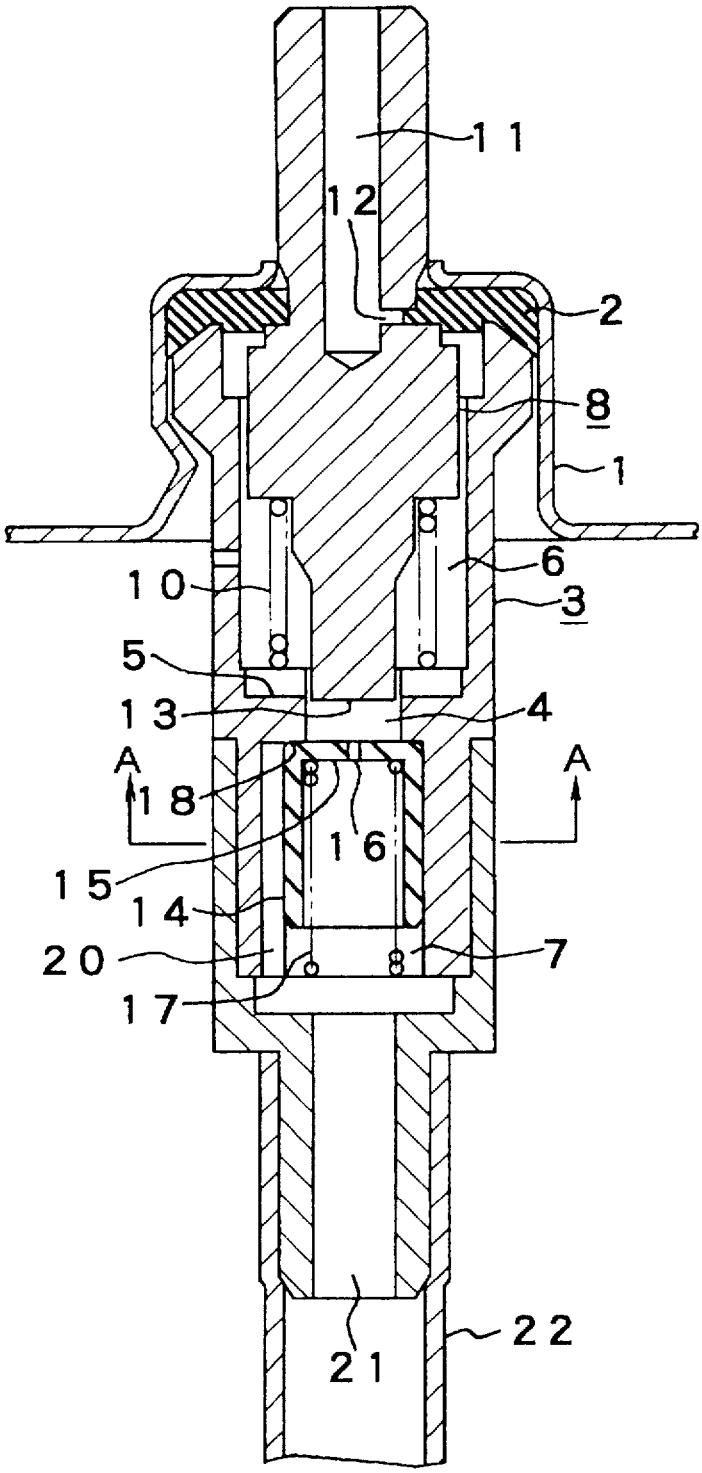
FIG. 1 is a cross-sectional view of a valve device for an aerosol container according to an embodiment of the present invention.

Since the valve devices for aerosol containers according to the present invention are constructed in the above-described manner, a push down rate of a stem of each of the valve devices for aerosol containers is made small when aerosol contents are intended to be sprayed on a small area. The close contact of a stem gasket with an orifice is released by the push down of the stem at this small rate. Therefore, the aerosol contents are introduced from the lower chamber into the upper chamber through a flow path for small spraying in a change-over valve and sprayed out from the orifice in the stem installed in the upper chamber.

As described above, the aerosol contents are sprayed out from the stem through the flow path for small spraying by the push down of the stem at the small rate, so that a small amount of the aerosol contents per unit time is sprayed out, and its spray pattern also necessarily becomes small. A pressing part situated at the lower end of the stem is brought into no contact with the change-over valve by the push down of the stem at this small rate.

When a spray pattern is intended to make large, the stem is pushed down to a greater extent compared with the case of the aforementioned small spraying. The change-over valve is pressed down by the pressing part situated at the lower end of the stem by the push down of the stem at this large rate, so that the contact of the change-over valve with the valve seat is released, and the insertion hole is hence opened greatly. As a result, a large amount of the aerosol contents flows into the upper chamber through the insertion hole greatly opened and sprayed out of a nozzle through the orifice under strong pressure.

The aerosol contents sprayed from the nozzle of the aerosol container can achieve a wide spray pattern owing to this strong spray pressure and the large amount of the aerosol contents, and moreover the amount of the aerosol contents sprayed per unit time naturally becomes larger.

When the outer diameter of the change-over valve is made smaller than the inner diameter of the lower chamber in order to increase the amount of the contents sprayed, whereby a space through which the aerosol contents flow is provided between the outer peripheral surface of the change-over valve and the inner peripheral surface of the lower chamber, the aerosol contents can be introduced into the insertion hole through this flow space, so that a larger amount of the aerosol contents can be caused to flow into the upper chamber to increase the amount of the aerosol contents sprayed.

In order to increase the amount sprayed, a concave groove through which the aerosol contents flow may also be formed in an inner surface of the lower chamber facing the outer periphery of the change-over valve. The aerosol contents can be introduced into the insertion hole through this concave flow groove, so that a large amount of the aerosol contents can be caused to flow into the upper chamber. In this case, the change-over valve can be brought into surface contact with the inner periphery of the lower chamber except for the concave flow groove. Therefore, the vertical movement of the change-over valve can be stably conducted.

When the pressing part situated at the lower end of the stem is made insertable into the insertion hole, the change-over valve is pressed down by the stem which has been greatly pushed down through the insertion hole, whereby the contact of the change-over valve with the valve seat is released. As a result, the insertion hole is opened to a great extent, so that a large amount of the aerosol contents flows into the upper chamber and sprayed out of a nozzle through the orifice under strong pressure. When the pressing part situated at the lower end of the stem is made insertable into the insertion hole, the vertical movement of the stem is regulated by the insertion hole, so that the stem is made vertically movable stably without any deflection or the like.

When the part of the change-over valve to be pressed by the stem is projected into the upper chamber from the insertion hole to face the pressing part situated at the lower end of the stem, there is no need to insert the pressing part situated at the lower end of the stem into the insertion hole, so that the strict accuracy in assembly and work of the stem is not required.

The aerosol containers in which the valve device according to the present invention has been incorporated may be used for containing, for example, hair cosmetics, cosmetics, deodorants, perspiration preventives, other goods for human bodies; insecticides, coating formulations, cleaners, other household goods; industrial goods; and automotive goods. More specifically, they may be used for hair-setting sprays, hair-dresser conditioners, hair shampoos, hair rinses, acid hair dyes, two-component type permanent hair dyes, color sprays, bleaching formulations, permanent wave formulations, hair growth tonics and the like as the hair cosmetics. They may also be used for shaving creams, after-shave lotions, perfumes, Eau de Cologne, face cleansers, sun-screening formulations, foundations, depilatory agents, decolorants, bath products, dentifrice and the like as the cosmetics. Further, they may be used for deodorants, perspiration preventives, body shampoos and the like. Still further, they may be used for antiphologistics for muscles, dermatotherapeutic agents, antidermatophytic agents, other medicines, insect repellents, coolants, sanitizers, mouthwashes and the like as the other goods for human bodies.

They may also be used for insecticides for spraying in the air, insecticides for cockroach, horticultural insecticides, miticides, bugfuges and the like as the insecticides. Further, they may be used for household paints, automotive paints, undercoatings and the like as the coating formulations. Besides, they may be used for household glass cleaners, lens cleaners, carpet cleaners, bath cleaners, polishing cleaners for floor and furniture, cleaners for shoes and leather, wax polishers and the like as the cleaners. Furthermore, they may be used for room deodorants, toilet deodorants, waterproofing agents, laundry starch, herbicides, mothproofing agents for clothing, flameproofing agents, fire extinguishing agents and the like as the other household goods.

Further, they may be used for lubricating rust preventives, adhesives, metal flaw detecting agents, releasing agents and the like as the industrial goods. Besides, they may be used for anticlouding agents, thawing agents, engine starting fluids, puncture menders, engine cleaners and the like as the automotive goods. Besides the uses for the above-mentioned contents, the aerosol containers may also be used for animal goods, goods for hobby and recreation, food and the like.

EMBODIMENTS OF THE INVENTION

An valve device for an aerosol container according to an embodiment of the present invention will hereinafter be described with reference to FIGS. 1 to 4. Incidentally, in the following embodiments, like reference numerals designate like or corresponding parts throughout. Reference numeral 1 designates a lid fixed to the upper end of the aerosol container. A housing 3 is fixed to the inner surface of the lid through a stem gasket 2. A partition wall 5 in the center of which an insertion hole 4 has been made is provided in the housing 3. An upper chamber 6 and a lower chamber 7 are defined by the partition wall 5 above and below the partition wall 5, respectively. A stem 8 the upper end of which is projected outside the lid 1 is installed in the upper chamber 6.

The stem 8 is pressed and biased toward the outside by a stem spring 10. A spraying path 11 for aerosol contents is axially formed in the stem 8 from the upper end thereof, and an orifice 12 which communicates with the spraying path 11 is opened from the side of the stem 8. The orifice 12 is constructed in such a manner that it is usually closed by the inner end of the stem gasket 2, and the close contact of the orifice 12 with the inner end of the stem gasket 2 is released by pushing down the stem 8 to permit the communication of the interior of the housing 3 with the exterior thereof.

The stem 8 is also formed in such a manner that a pressing part 13 situated at the lower end of the stem 8 is insertable into the insertion hole 4 bored in the partition wall 5 which divides the upper chamber 6 from the lower chamber 7, and the pressing part 13 situated at the lower end thereof is insertable down to the lower chamber 7 when the stem 8 is pushed down to a great extent, while it is not inserted down to the lower chamber 7 though the closed relation between the stem gasket 2 and the orifice 12 is released when pushed down to a small extent.

A change-over valve 14 is vertically movably installed in the lower chamber 7. The change-over valve 14 is constructed in the form of a cylinder of a turned square U-shaped cross-section. A flow path 16 for small spraying, through which a small amount of the aerosol contents can pass, is opened in a top plate 15 situated at the upper end of the change-over valve 14. A spring 17 is provided between the lower-side inner surface of the top plate 15 and the bottom of the lower chamber 7 to usually press the change-over valve 14 toward the insertion hole 4 so as to bring the change-over valve 14 into contact with a valve seat 18 provided on the lower surface of the partition wall 5.

In a state that the change-over valve 14 is brought into contact with the partition wall 5, the communication of the lower chamber 7 with the upper chamber 6 is carried out only through the flow path 16 for small spraying. A concave groove 20 through which the aerosol contents flow is vertically formed in an inner surface of the lower chamber 7 facing the outer periphery of the change-over valve 14 so as to permit a flow of a large amount of the aerosol contents. The upper end of the concave flow groove 20 formed reaches the lower surface of the partition wall 5, so that the concave flow groove 20 does not communicate the lower chamber 7 with the upper chamber 6 in the state that the change-over valve 14 is pressed against the valve seat 18 provided on the lower surface of the partition wall 5. The valve seat 18 is formed on the lower chamber side of the partition wall 5 formed integrally with the housing 3 by projecting the inner peripheral surface of the housing 3 inward.

An inflow port 21 for the aerosol contents is formed at the lower end of the lower chamber 7 of the housing 3, and a dipping tube 22 is connected to this inflow port 21.

Figure 8:
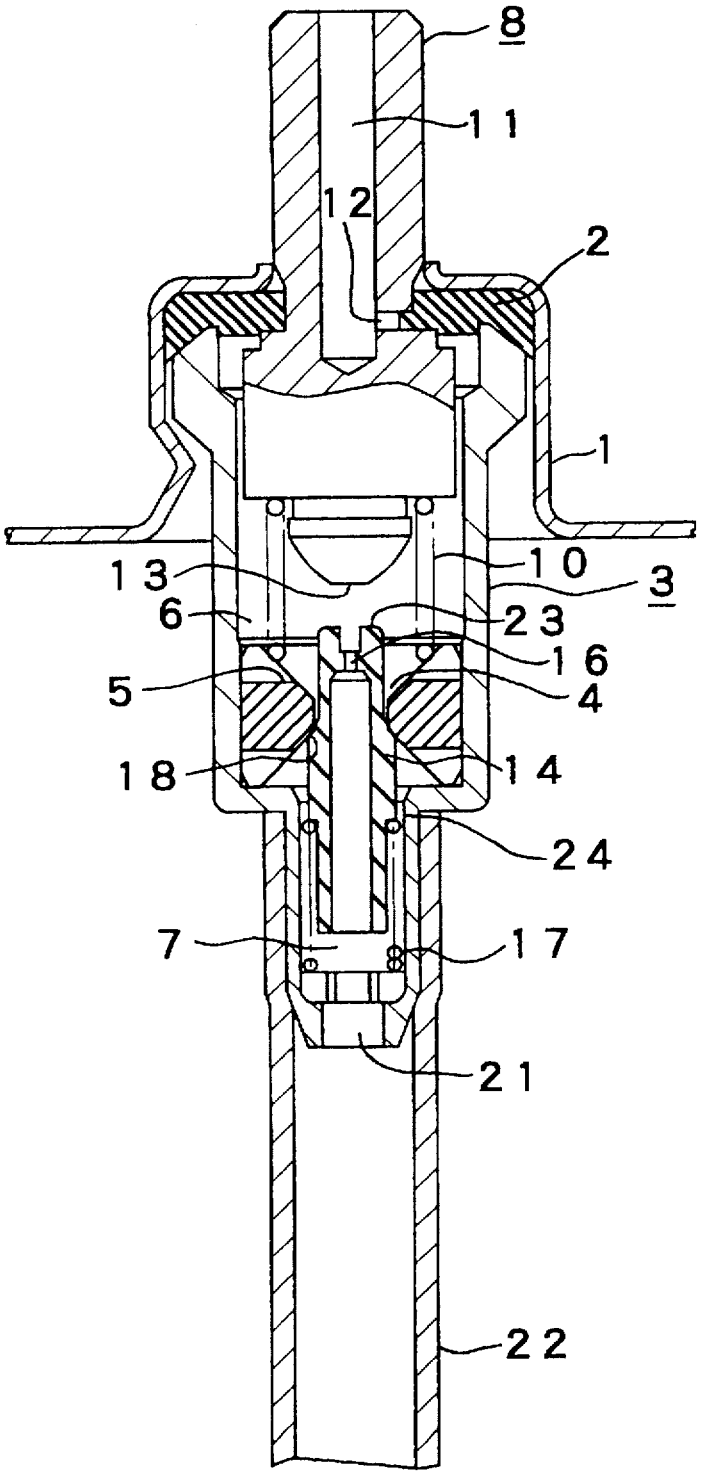
FIG. 8 is a cross-sectional view of a valve device for an aerosol container according to a third embodiment, wherein a partition wall is provided separately from a housing.

In the valve device constructed in the above-described manner, the stem 8 is pressed and biased outward by the pressing force of the stem spring 10 in a state that the aerosol contents are not sprayed and the stem 8 is not pushed down as illustrated in FIG. 8, so that the orifice 12 in the stem 8 is closed by the inner end of the stem gasket 2. A fixed space is defined between the pressing part 13 situated at the lower end of the stem 8 and the change-over valve 14 and is such that the change-over valve 14 is not pressed down when the stem 8 is pushed down to a small extent.

Figure 2:
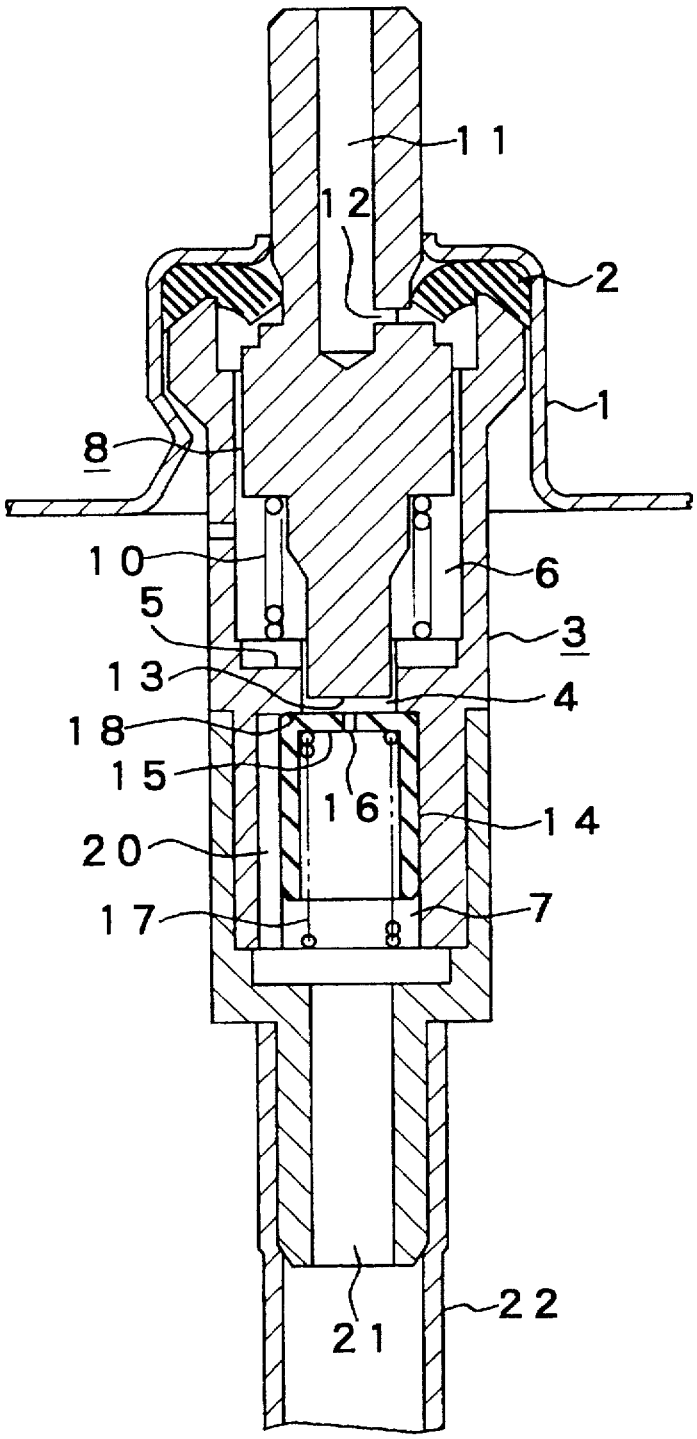
FIG. 2 is a cross-sectional view of the valve device illustrating a state of small spraying.

When the aerosol contents are intended to be sprayed in a small amount, namely, the spraying on a small area is conducted on a small pattern, the stem 8 is pushed down to a small extent by small pressing force as illustrated in FIG. 2. In this state, the pressing part 13 situated at the lower end of the stem 8 does not press the change-over valve 14, so that the change-over valve is not pressed down though the closed relation between the inner end of the stem gasket 2 and the orifice 12 is released.

In this state, the aerosol contents are introduced into the housing through the dipping tube 22, the inflow port 21 and the lower chamber 7 and can be caused to flow into the upper chamber 6 only through the flow path 16 for small spraying. Therefore, the amount of the aerosol contents to be sprayed is limited only to an amount of the aerosol contents which pass through the flow path 16 for small spraying, and so only a small amount of the aerosol contents is sprayed. Since the amount sprayed is small, an area sprayed also becomes small.

Figure 3:
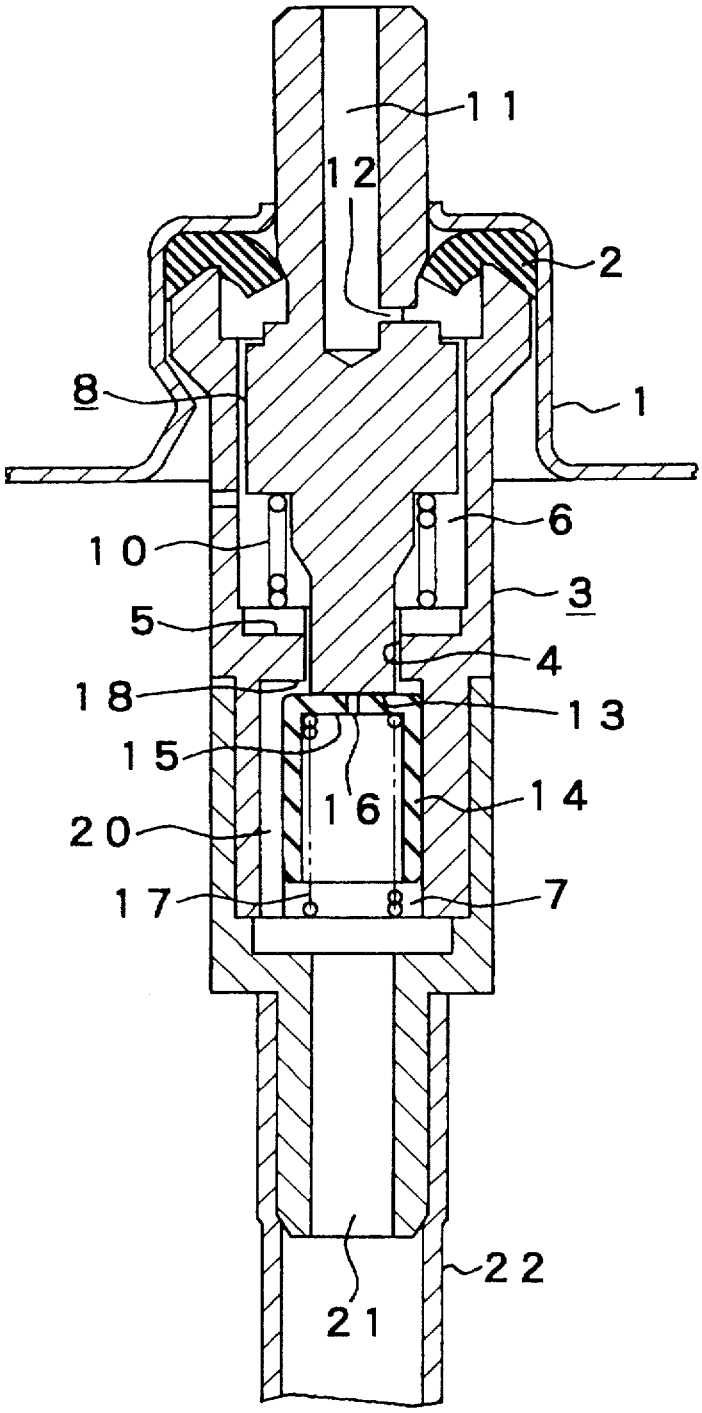
FIG. 3 is a cross-sectional view of the valve device illustrating a state of large spraying on a wide pattern.
Figure 4:
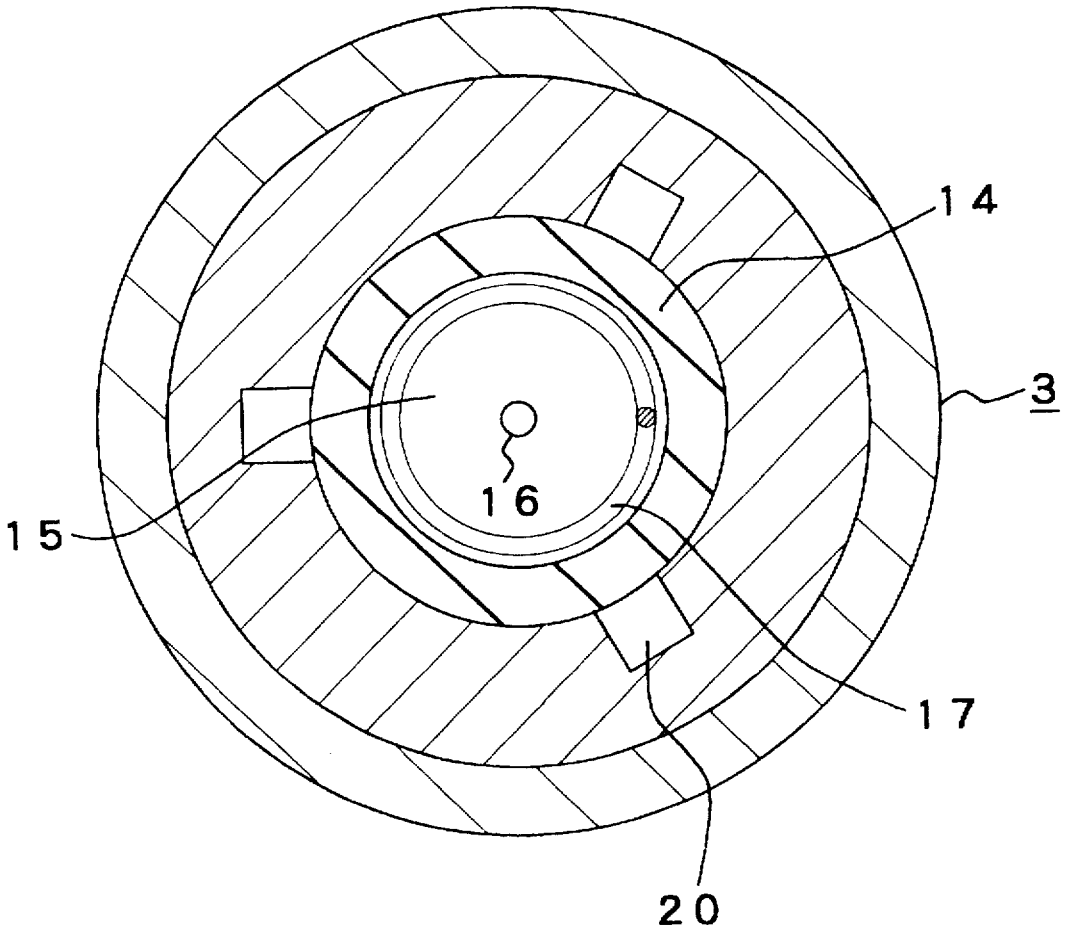
FIG. 4 is an enlarged sectional view taken on line A—A of FIG. 1.

When it is intended to obtain a large or wide spray area, the stem 8 is pushed down in the aerosol container to a great extent as illustrated in FIG. 3. The change-over valve 14 is pressed down by the pressing part 13 of the stem 8 according to this great push down of the stem 8 and separated from the valve seat 18. Therefore, the closing of the insertion hole 4 by the change-over valve 14 is released, so that the aerosol contents flowed from the dipping tube 22 and the inflow port 21 are introduced into the insertion hole 4 through the concave flow groove 20 and flow into the upper chamber 6 through the insertion hole 6. Therefore, a large amount of the aerosol contents can be sprayed out through the orifice 12 from the upper chamber 6.

The aerosol contents are sprayed in a wide range from the nozzle by this spraying of the contents in the large amount. Accordingly, the amount of the aerosol contents sprayed per unit time is increased compared with the small pattern. However, it is possible to make the amount sprayed per unit area scarcely changed compared with the case of the small spraying because the spray area becomes greater.

Therefore, in the case of the small spraying, supply of excess of the aerosol contents, which may causes problems such as sag, is prevented even if the aerosol contents are sprayed on a small area. On the other hand, there is no need to spray the aerosol contents over a long period of time as in the past even if the aerosol contents are sprayed on a wide area, so that the spraying of the aerosol content on the wide area can be efficiently conducted.

Accordingly, the process of this valve device is optionally used properly according to various purposes such as spray of a coating formulation, spray of a medicine on a body surface and spray of a hair cosmetic on hair, whereby the aerosol contents can be sprayed efficiently and economically.

Figure 5:
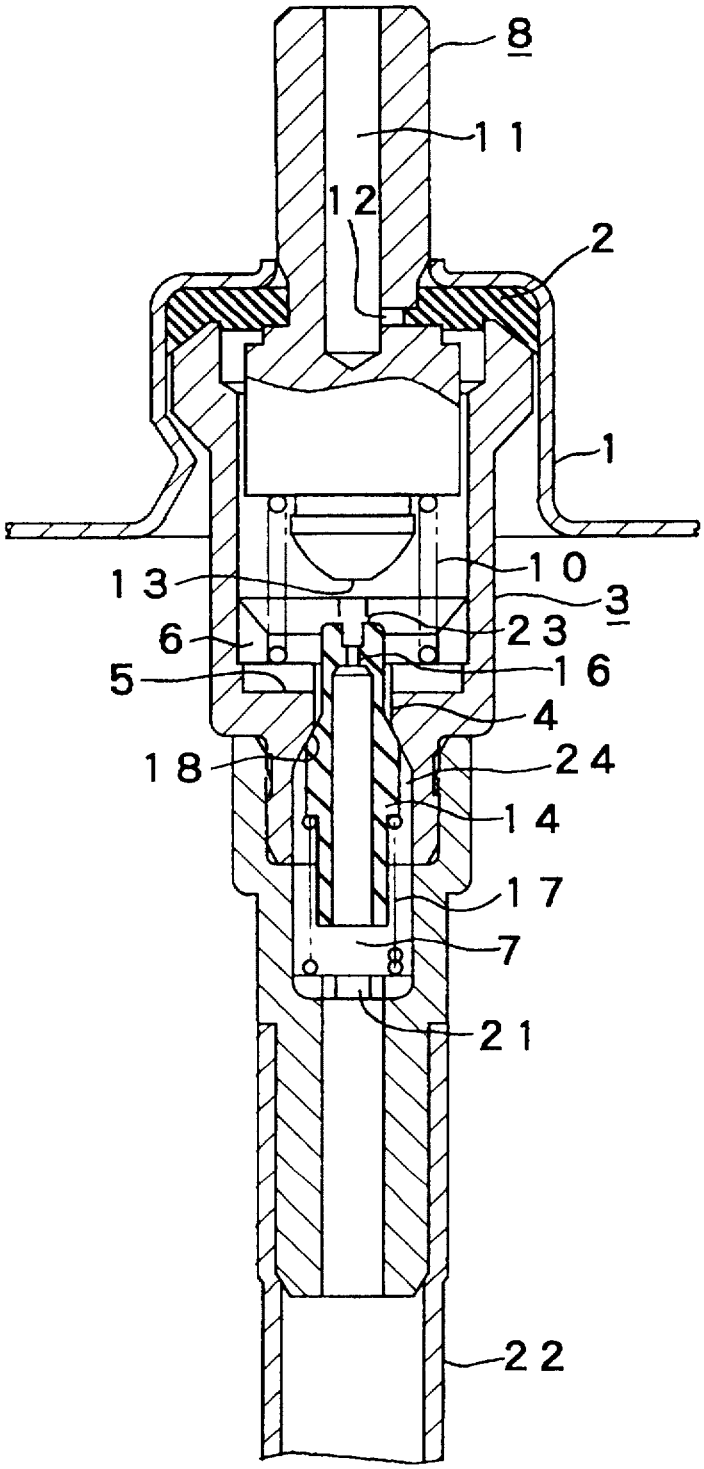
FIG. 5 is a cross-sectional view of a valve device for an aerosol container according to a second embodiment illustrating a state that a part of a change-over valve to be pressed is projected on the side of the upper chamber.
Figure 6:
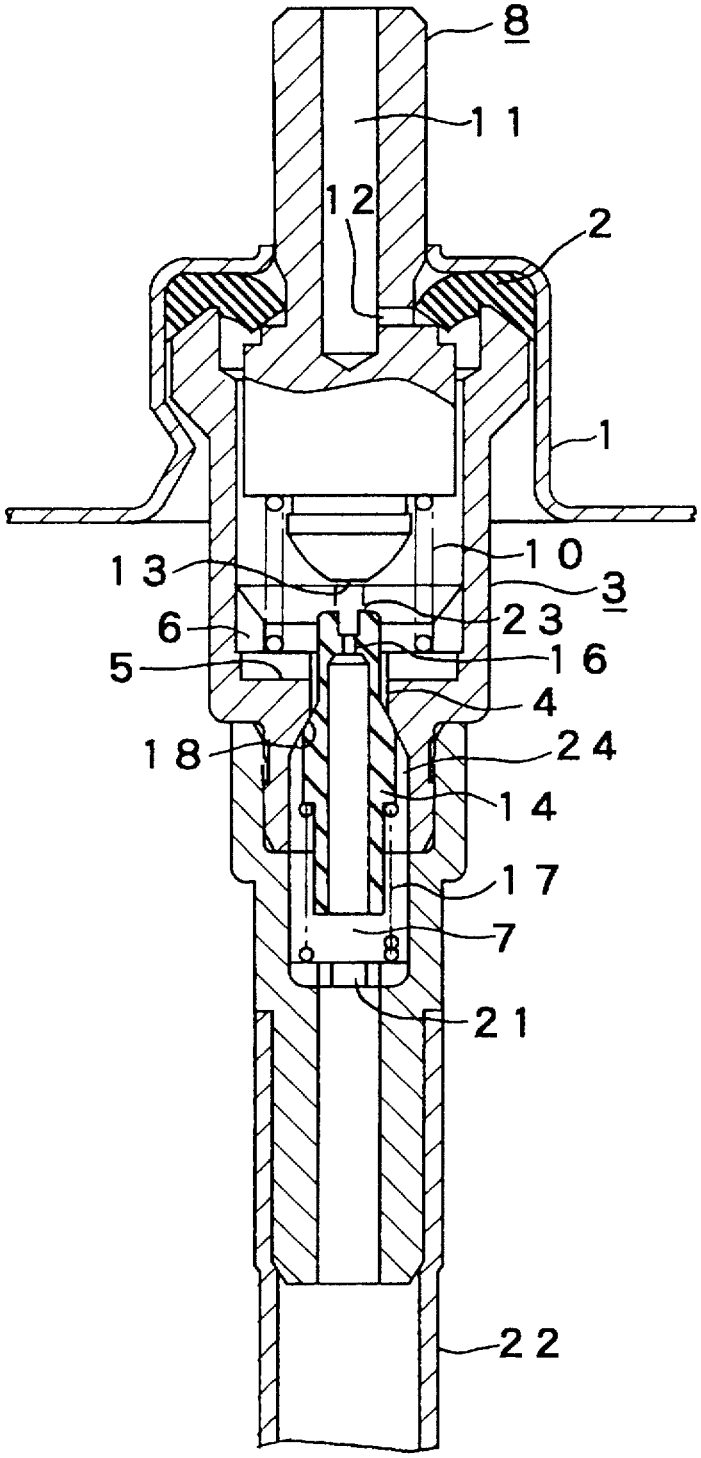
FIG. 6 is a cross-sectional view of the valve device according to the second embodiment illustrating a state of small spraying.
Figure 7:
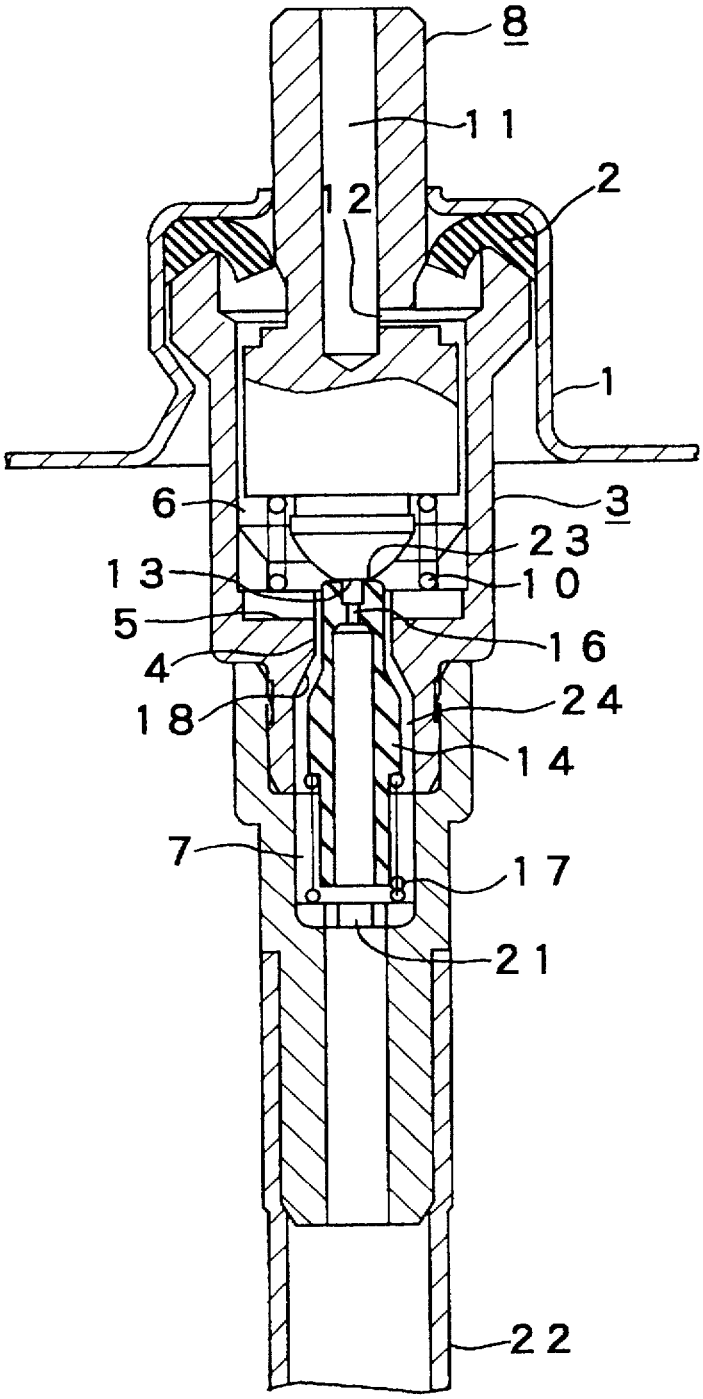
FIG. 7 is a cross-sectional view of the valve device according to the second embodiment illustrating a state of large spraying on a wide pattern.

In the above-described first embodiment, the pressing part 13 situated at the lower end of the stem 8 is insertable into the insertion hole 4 bored in the partition wall 5 which divides the upper chamber 6 from the lower chamber 7. In a second embodiment of the present invention, however, a stem 8 is so constructed that a pressing part 13 situated at the lower end thereof is not inserted into an insertion hole 4 as illustrated in FIGS. 5 to 7. According to the process of this valve device, the pressing part 13 of the stem 8 is arranged facing the insertion hole 4, and a part 23 of a change-over valve 14 to be pressed is projected on the side of an upper chamber 6 through the insertion hole 4.

When the part 23 of the change-over valve 14 to be pressed is projected on the side of the upper chamber 6 through the insertion hole 4 to face the pressing part 13 situated at the lower end of the stem 8 as described above, there is no need to insert the pressing part 13 of the stem 8 into the insertion hole 4, so that the strict accuracy in assembly and work of the stem 8 is not required.

In this case, a concave flow groove 20 may also be vertically formed in an inner surface of a lower chamber 7 facing the outer periphery of the change-over valve 14. In the second embodiment, however, the change-over valve 14 is formed in such a manner that its outer diameter is smaller than an inner diameter of the lower chamber 7, whereby a space 24 through which aerosol contents flow is provided between the outer peripheral surface of the change-over valve 14 and the inner peripheral surface of the lower chamber 7. It is therefore possible to cause a large amount of the aerosol contents to flow into the upper chamber 6 through this space 24 when the change-over valve 14 is opened.

Figure 9:
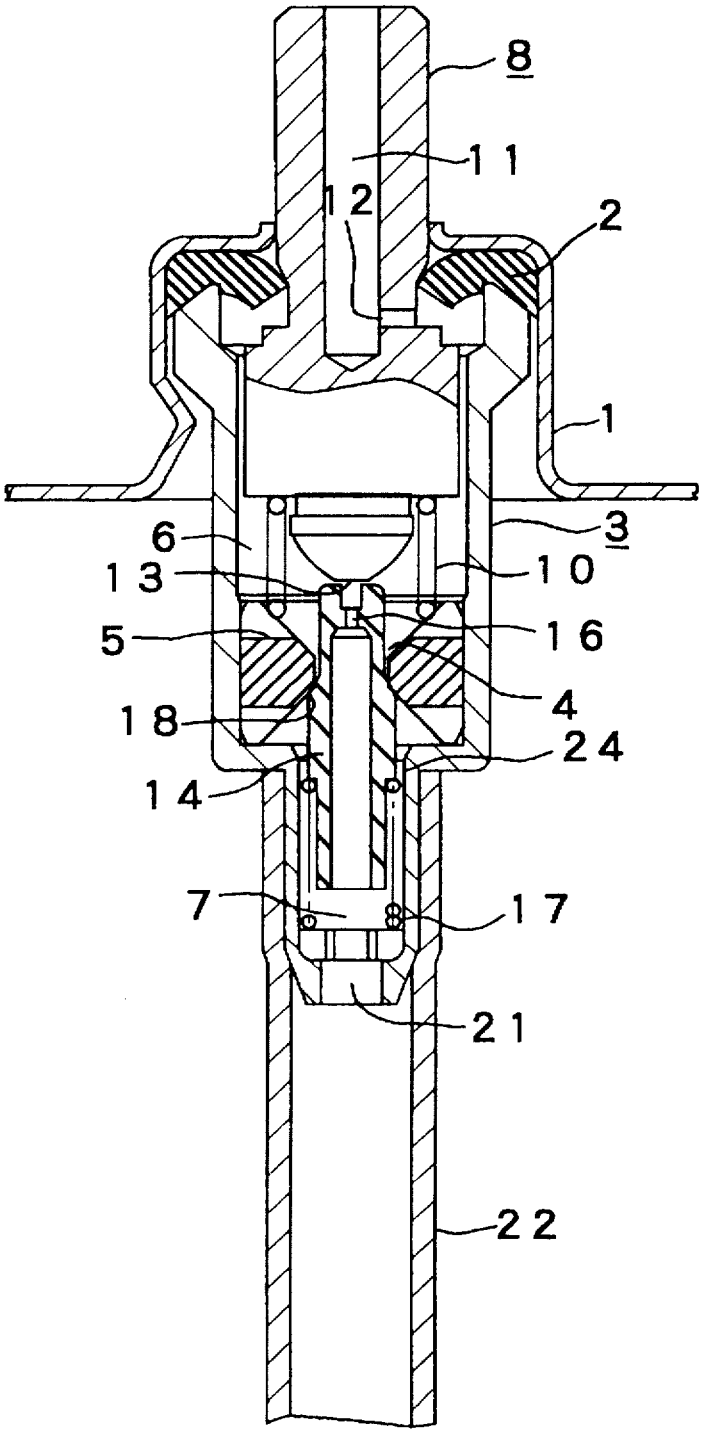
FIG. 9 is a cross-sectional view of the valve device according to the third embodiment illustrating a state of small spraying.
Figure 10:
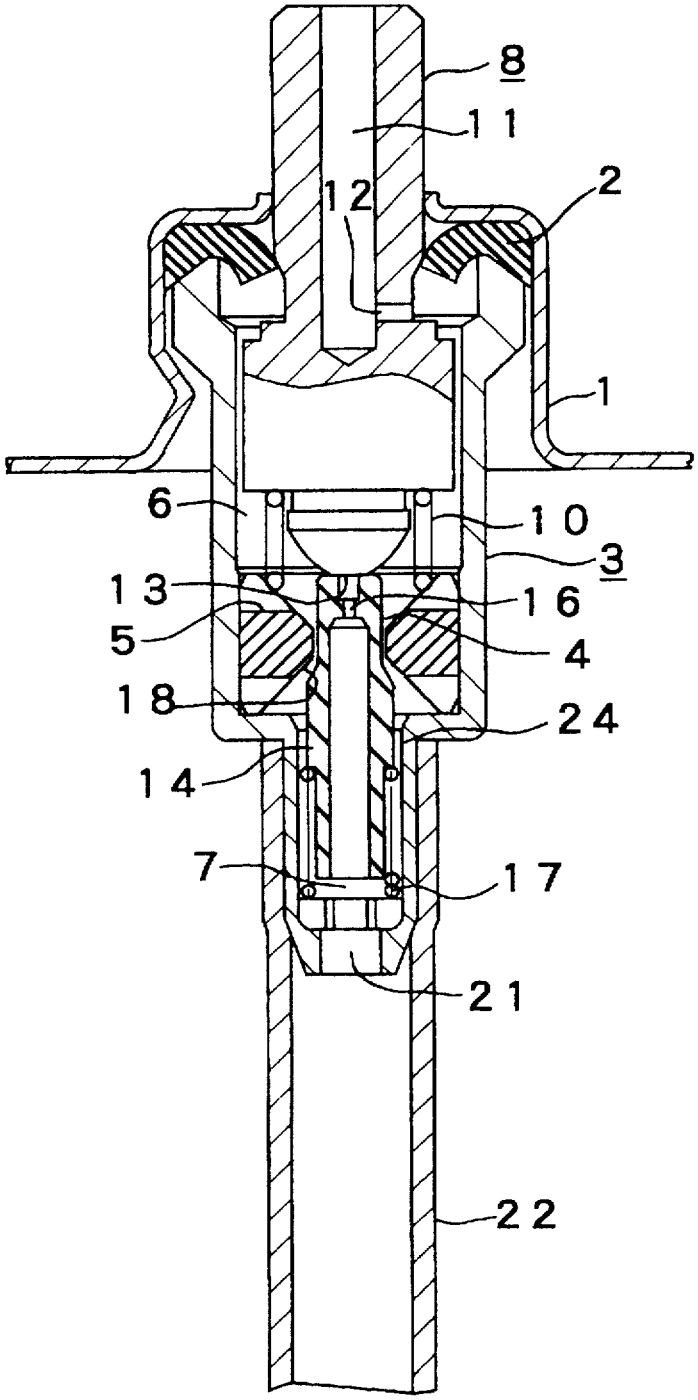
FIG. 10 is a cross-sectional view of the valve device according to the third embodiment illustrating a state of large spraying on a wide pattern.

In the first and second embodiments, the partition wall 5 is formed integrally with the housing 3 by projecting the inner peripheral surface of the housing 3 inward. In a third embodiment of the present invention, however, a partition wall 5 is formed by inserting and installing a ring-like member formed separately from a housing 3 as illustrated in FIGS. 8 to 10.

The construction according to the third embodiment permits conducting the installation of all valve members in the interior of the housing 3 from the upper side of the housing 3, so that the assembly operation of the valve device can be performed with ease, resulting in improved workability. More specifically, a spring 17, a change-over valve 14, a ring-like partition wall 5, a stem gasket 2 and a stem 8 can be incorporated into the housing 3 in that order.

On the other hand, since the partition wall 5 is formed integrally with the housing 3 by projecting the inner peripheral surface of the housing 3 inward in the first and second embodiments, it is necessary to incorporate the stem 8 and the stem gasket 2 from the upper side of the housing 3 and incorporate the change-over valve 14 from the lower side of the housing 3. However, the incorporation of the members can be conducted with ease in the third embodiment as described above, but it is necessary to form the ring-like partition wall 5 separately, which possesses a drawback of increasing the number of members.

In the case where contents for a soft type hair spray, hair mousse, kerosene-based insecticide for spraying in the air, water-based horticultural insecticide, permanent wave formulation or coating formulation are charged into an aerosol container formed using such a valve device as described above, formulation examples of the respective contents will hereinafter be described.

Soft type hair spray:

| | |
|---|---|
| Alkanolamine solution of an acrylic resin (30%) | 2.00 wt. % |
| Polyoxyethylene oleyl ether | 0.01 wt. % |
| Perfume base | 0.17 wt. % |
| Denatured ethyl alcohol | 52.82 wt. % |
| Propellant, LPG | 45.00 wt. % |
| Total | 100.00 wt. %. |

Hair mousse:

| | |
|---|---|
| Denatured ethyl alcohol | 9.00 wt. % |
| Cetyl alcohol | 0.20 wt. % |
| Stearyl alcohol | 0.20 wt. % |
| Methylpolysiloxane-polyoxyalkylene copolymer | 0.10 wt. % |
| Polyoxyethylene stearyl ether | 0.60 wt. % |
| Cationized cellulose | 3.00 wt. % |
| Polyoxyethylene sorbitan monolaurate | 0.40 wt. % |
| Hydrolyzed collagen | 0.40 wt. % |
| Glycerol | 0.10 wt. % |
| Stearyltrimethylammonium chloride | 0.05 wt. % |
| Perfume base | 0.10 wt. % |
| Purified water | 79.25 wt. % |
| Propellant, LPG | 7.00 wt. % |
| Total | 100.00 wt. %. |

Kerosene-based insecticide for spraying in the air:

| | |
|---|---|
| Insecticidal chemical | 0.35 wt. % |
| Efficacy-enhancing agent | 1.95 wt. % |
| Perfume base | 0.01 wt. % |
| Kerosene | 47.69 wt. % |
| Propellant, LPG | 50.00 wt. % |
| Total | 100.00 wt. %. |

Water-based horticultural insecticide:

| | |
|---|---|
| Insecticidal chemical | 0.74 wt. % |
| Activator | 0.07 wt. % |
| Rust preventive | 0.30 wt. % |
| Silicone | 0.07 wt. % |
| Ion-exchanged water | 72.32 wt. % |
| Propellant, DME/LPG = 70/30 | 26.50 wt. % |
| Total | 100.00 wt. %. |

Permanent wave formulation:

| | |
|---|---|
| Ammonium thioglycolate (50% aqueous solution) | 9.50 wt. % |
| Aqueous ammonia (28%) | 1.40 wt. %. |
| Liquid paraffin | 0.95 wt. % |
| Surfactant | 1.90 wt. % |
| Propylene glycol | 4.75 wt. % |
| Chelating agent | 0.10 wt. % |
| Purified water | 76.40 wt. % |
| Propellant, LPG | 5.00 wt. % |
| Total | 100.00 wt. %. |

Ammonium thioglycolate (50% aqueous solution) 99.50 wt. %

Aqueous ammonia (28%) 1.40 wt. %

Liquid paraffin 0.95 wt. %

Surfactant 1.90 wt. %

Propylene glycol 4.75 wt. %

Chelating agent 0.10 wt. %

Purified water 76.40 wt. %

Propellant, LPG 5.00 wt. %

Total 100.00 wt. %

Coating formulation:

| | |
|---|---|
| Resin | 5.08 wt. % |
| Pigment | 3.60 wt. % |
| Additive | 0.60 wt. % |
| Solvent | 30.72 wt. % |
| Propellant, DME/LPG = 90/10 | 60.00 wt. % |
| Total | 100.00 wt. %. |

What is claimed is:

1. A valve device for an aerosol container, comprising a housing the upper end of which is fixed to the interior of a lid, a partition wall arranged in the housing and provided with an insertion hole, an upper chamber provided above the partition wall, a lower chamber provided below the partition wall, a stem vertically movably installed in the upper chamber and provided with a pressing part at its lower end, the upper end of said stem being biased and projected outward from the lid through a stem gasket, a change-over valve vertically movably installed in the lower chamber facing the pressing part situated at the lower end of the stem, and a flow path for small spraying, which is made in the change-over valve and communicates the upper chamber with the lower chamber, wherein the change-over valve is pressed against and biased toward a valve seat provided on the lower surface of the partition wall, whereby the communication of the upper chamber with the lower chamber is cut off except for through the flow path for small spraying, and the insertion hole can be opened by pressing down the change-over valve by the stem.

2. A valve device for an aerosol container according to claim 1, wherein the upper chamber and the lower chamber are defined by a partition wall provided integrally with the housing by projecting the inner peripheral surface of the housing inward.

3. A valve device for an aerosol container according to claim 1, wherein a ring-like partition wall formed separately from the housing is inserted and installed in the housing to define the upper chamber and the lower chamber by the ring-like partition wall.

4. A valve device for an aerosol container according to claim 1, wherein a concave groove through which the aerosol contents flow is formed in an inner surface of the lower chamber facing the outer periphery of the change-over valve in order that the concave flow groove can be communicated with the insertion hole when the change-over valve is pressed down by the stem.

5. A valve device for an aerosol container according to claim 1, wherein the change-over valve is formed in such a manner that its outer diameter is smaller than an inner diameter of the lower chamber, whereby a space through which the aerosol contents flow is provided between the outer peripheral surface of the change-over valve and the inner peripheral surface of the lower chamber.

6. A valve device for an aerosol container, comprising a housing the upper end of which is fixed to the interior of a lid, a partition wall arranged in the housing and provided with an insertion hole, an upper chamber provided above the partition wall, a lower chamber provided below the partition wall, a stem vertically movably installed in the upper chamber and provided with a pressing part at its lower end, the upper end of said stem being biased and projected outward from the lid through a stem gasket and said pressing part situated at the lower end of the stem being insertable into the insertion hole, a change-over valve vertically movably installed in the lower chamber facing the pressing part situated at the lower end of the stem, and a flow path for small spraying, which is made in the change-over valve and communicates the upper chamber with the lower chamber through the insertion hole, wherein the change-over valve is pressed against and biased toward a valve seat provided on the lower surface of the partition wall, whereby the insertion hole is cut off except for through the flow path for small spraying, and the insertion hole can be opened by pressing down the change-over valve by the stem.

7. A valve device for an aerosol container, comprising a housing the upper end of which is fixed to the interior of a lid, a partition wall arranged in the housing and provided with an insertion hole, an upper chamber provided above the partition wall, a lower chamber provided below the partition wall, a stem vertically movably installed in the upper chamber and provided with a pressing part at its lower end, the upper end of said stem being biased and projected outward from the lid through a stem gasket, said pressing part situated at the lower end of the stem being arranged facing the insertion hole, a change-over valve vertically movably installed in the lower chamber facing the pressing part situated at the lower end of the stem, a part of said change-over valve to be pressed by the stem being projected into the upper chamber from the insertion hole, and a flow path for small spraying, which is made in the change-over valve and communicates the upper chamber with the lower chamber, wherein the change-over valve is pressed against and biased toward a valve seat provided on the lower surface of the partition wall, whereby the insertion hole is cut off except for through the flow path for small spraying, and the insertion hole can be opened by pressing down the change-over valve by the stem.

* * * * *